US005911487A

United States Patent [19]

Dricken

[11] Patent Number: 5,911,487

[45] Date of Patent: Jun. 15, 1999

[54] VACUUM DEGASSER TANK

[75] Inventor: Robert L. Dricken, 5601 W. Wisconsin Ave., Milwaukee, Wis. 53213

[73] Assignee: Robert L. Dricken, Milwaukee, Wis.

[21] Appl. No.: 08/984,363

[22] Filed: Dec. 3, 1997

Related U.S. Application Data

[63] Continuation-in-part of application No. 08/710,867, Sep. 23, 1996, abandoned.

[51] Int. Cl.[6] ..... F26B 13/30

[52] U.S. Cl. ..... 34/92

[58] Field of Search ..... 34/92, 130, 605, 34/202, 224, 207, 225; 417/442, 503, 511

[56] References Cited

U.S. PATENT DOCUMENTS

| | | | |
|---|---|---|---|
| 2,288,616 | 7/1942 | Freund | 34/549 |
| 3,521,373 | 7/1970 | Pagnozzi | 34/406 |
| 3,538,616 | 11/1970 | Malling | 34/92 |
| 3,698,098 | 10/1972 | Ramsay | 34/403 |
| 4,698,917 | 10/1987 | Debolini | 34/92 |
| 4,975,028 | 12/1990 | Schultz | 417/442 |
| 5,556,473 | 9/1996 | Olson et al. | 118/719 |

*Primary Examiner*—Henry Bennett
*Assistant Examiner*—Steve Gravini
*Attorney, Agent, or Firm*—Ryan Kromholz & Manion, S.C.

[57] ABSTRACT

A degasser tank which is used to remove moisture from welding flux, welding rods, welding wire and welding torch components comprising an airtight tank chamber and a vacuum pump for decreasing the pressure in the tank chamber to substantially zero pounds per square inch. An optional viewing window, and input and output control valves for regulating material flow are attached to the chamber. The vacuum drying process provides a more efficient and safe method of dehumidifying welding materials.

17 Claims, 2 Drawing Sheets

VACUUM DEGASSER TANK

This is a continuation-in-part of U.S. patent application Ser. No. 08/710,867 filed Sep. 23, 1996, now abandoned.

BACKGROUND OF THE INVENTION

The present invention relates generally to the dehumidification of porous materials, and in particular, mineral coated electrodes and flux material. More particularly, this invention relates to the holding and reconditioning of welding rod coatings, welding wire fluxes and coatings, and welding flux materials by maintaining appropriate moisture levels within the coating and flux material. The present invention can also be utilized for dehumidification of welding apparatus including welding torch components having an affinity to moisture.

Welding involves permanently joining sections of metallic material together by bringing those sections together and briefly heating each metallic surface to a molten state, and allowing the materials to cool. Welding is considered one of the strongest methods of joining metal because the process creates an atomic bond between the materials being welded. A widely used method of welding various metallic materials together is arc welding. Arc welding involves passing high levels of electricity through a welding rod or wire across the surface of the materials to be welded. The heat caused by the transfer of electricity between the welding rod or wire and the material to be welded causes the immediate contact area of each to melt and become welded together.

The welding rod or wire is a critical component to the arc welding process. Welding rods are composed of a metallic center electrode rod coated with various amounts of a mineral flux. Welding rods come in a variety of lengths and are composed of a variety of electrode composite structures for welding various metallic compounds. As a welding rod is brought into contact with the metallic surfaces to be welded, the inner electrode melts and provides "filler" metallic material for the weld joint. As such, the welding rod is quickly consumed or "used up" and many welding rods are needed to complete most welding projects.

Welding wire, such as flux cored wire and composite/metal cored wire, typically has a core of mineral flux or composite that is surrounded by a metallic electrode. Welding wire is formed by either the drawing method or the rolling method. One of the drawbacks of either method is the formation of a seam along the length of the wire. The seam allows moisture to be absorbed into the flux. Similar to the welding rod, welding wire is brought into contact with the metallic surfaces to be welded and the electrode melts to provide a "filler" material for the weld. Welding wire ready for use is coiled on spools that are made from metal, masonite, plastic or cardboard.

A vital element to a strong weld is a molten environment free from impurities. Impurities on the surfaces of the materials being welded or the welding rod itself can cause cracks and gas pockets in the cooled weld that significantly reduces the strength and life of the weld. Welding flux acts as a catalyst and cleaning agent to the welding process and thereby strengthens the weld joint. It does this by removing oxides from the molten metal and creating a clean atmosphere around the molten metal while the pieces are joined.

However, unacceptable moisture levels within the flux (generally greater than 0.20 percent) can introduce impurities into the weld. The heat and the electric arc from the welding process break down the water moisture into its elements, hydrogen and oxygen. These elements in or near the molten weld are diffused into the weld and cause the cracks and gas pockets which weaken the weld.

All mineral coated electrodes and flux are highly absorbent and they begin absorbing moisture once unpacked from a suppliers airtight packaging. The seam commonly produced during the manufacture of welding wire also allows for moisture to be absorbed into the flux core. Because of this, welders commonly use readily available heated ovens or similar devices to bake the moisture from welding flux and welding rods. These ovens are used to both reduce the moisture content of materials that have exceeded acceptable levels and to store these materials at acceptable moisture levels. Ovens diffuse the moisture from the flux materials by means of heating the material to temperatures ranging from 250 to 1000 degrees Fahrenheit (120 to 540 degrees Celsius) from one to several hours. This heating method, while effective, is expensive and causes the materials to be difficult to work with until cooled. A further drawback is encountered with welding wire wound on plastic spools. Due to the low heat tolerance of the plastic spool, typically less than 150 degrees Fahrenheit (65 degrees Celsius), welding wire on a plastic spool cannot be heated in an oven.

The present invention provides an easier, quicker, and more efficient way to reduce and maintain the moisture content level of coated electrodes and welding flux. It can also be utilized to remove moisture from welding torches that have an affinity to moisture. The present invention comprises an airtight chamber which creates a vacuum around the materials placed within it to more efficiently expel moisture within the flux material.

SUMMARY OF THE INVENTION

The present invention comprises a degasser tank that is used to remove moisture from granular welding flux, welding rods, welding wire, and welding apparatus that has an affinity to moisture. The term welding wire as used herein shall include, but not be limited to, flux cored wire, composite/metal cored wire and hard wire. The tank utilizes a vacuum at 99.999% to draw the water out of the material or welding components and expel the water into the atmosphere.

The degasser tank comprises two embodiments, both using a substantially airtight chamber into which the granular flux material, welding rods, welding wire or welding torch components are placed and the interior of the chamber is then brought to a vacuum. The first embodiment comprises a tank closed at the bottom with a sealable, removable lid on the top of the tank used to place material into and remove material from the tank chamber.

The second embodiment of the invention comprises an airtight chamber with at least three valve controlled inlets and outlets for allowing material to enter the chamber, exit the chamber, and for connecting the chamber to a vacuum pump. This embodiment is best suited for removing moisture from granular welding flux materials.

Each embodiment offers significant benefits over the existing drying oven art. The present invention operates off a common 120 volt AC power supply. Depending upon vacuum pump size, the vacuum dehumidification method produces an estimated drying time of less than one hour after reaching full vacuum as compared to the four to six hours for an oven, and because the materials are not heated, they can be used immediately upon completion of the drying cycle. In addition, once the drying cycle is complete, no further energy is required to store the materials at the appropriate moisture level, the vacuum need only be retained within the airtight chamber.

This vacuum degasser provides safe, clean, and quite operation which requires no special training or safety considerations at an estimated cost savings of fifty percent over existing ovens having similar chamber sizes.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 2:
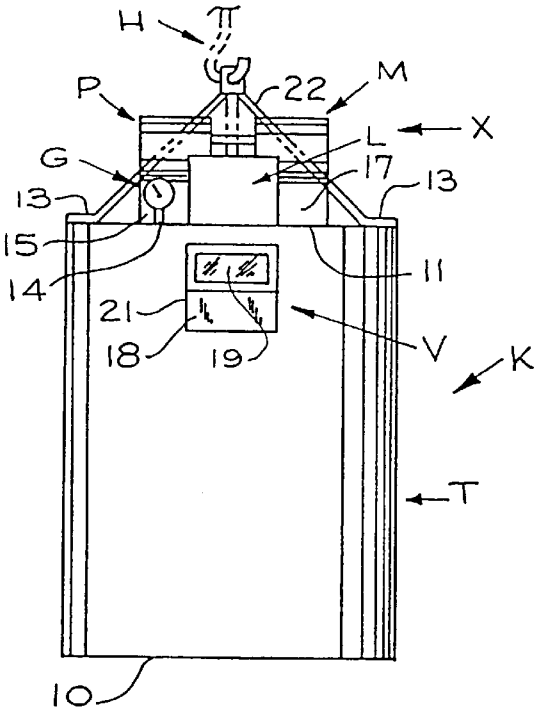
FIG. 2 is a front elevational view of the first embodiment of the degasser tank with the removable lid in place showing a vacuum gauge, a light housing, a viewing window, a vacuum pump and motor, and, in phantom, lid lift straps.
Figure 3:
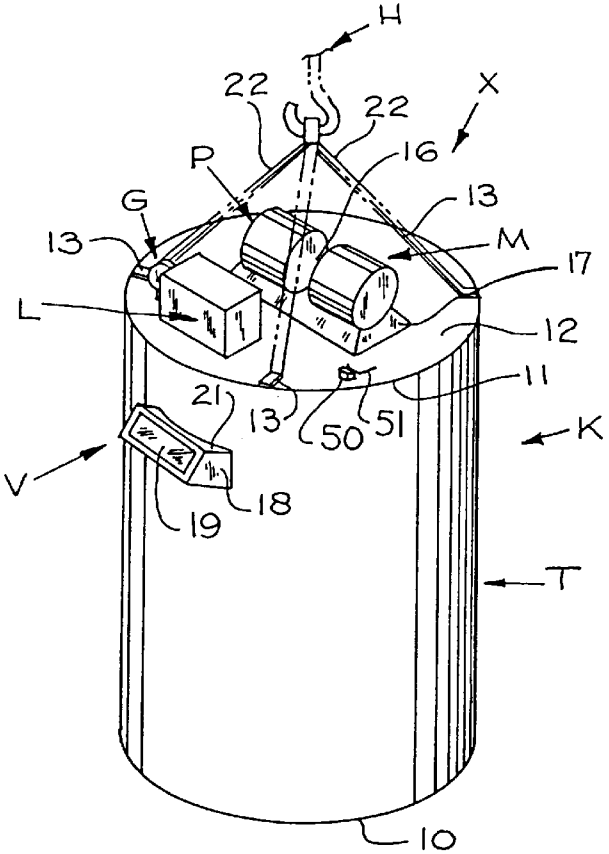
FIG. 3 is a perspective view of the same configuration as described in FIG. 2.

With reference to FIGS. 2 and 3, it will be noted the degasser tank K of this invention comprises a cylindrical tank chamber T permanently sealed at its bottom 10 by a circular plate (not shown) and a circular lid X removably sealing the top perimeter 11 of the tank chamber T. While the tank chamber T is disclosed in this preferred embodiment to be cylindrical in shape, it is to be understood that the tank chamber T could be formed in any shape. The preferred material of the tank chamber T and the lid section X is mild steel, but it is to be understood that a variety of materials may be used to accomplish the same desired function.

Figure 1:
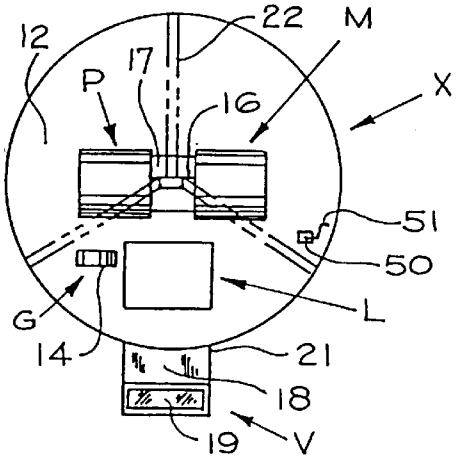
FIG. 1 is a top plan view of a first embodiment of the degasser tank showing the sealable removable lid section with lift straps drawn in phantom.

With additional reference to FIG. 1, the circular lid X has affixed to its top surface 12 a vacuum gage G, a vacuum pump P, a vacuum pump motor M, a vacuum release valve 50, and hoist strap clips 13. While it is not required to practice the present invention, a viewing window V and a light housing L may be incorporated toward the top of the tank chamber T to provide visibility of the contents of the tank chamber T.

The vacuum gauge G is connected to a hollow pipe 15 which extends through the circular lid X and slightly into the interior of the tank chamber T at position 14. The vacuum pump P is connected to the vacuum pump motor M by means of a drive shaft 16. The vacuum pump P is a MARVAC Scientific Z30 vacuum pump. However, different size pumps having different tank volumes and pump oil reservoir sizes could be utilized. The vacuum pump P and the pump motor M are each fastened to a pump shelf 17 which is fastened to the top surface 12 of the lid X. The light housing L comprises a rectangular socket for holding an electric lighting device or lighting means (not shown) within its interior. The light housing L is positioned above the viewing window V. The viewing window V comprises a generally upwardly angled sill section 19 fastened around an aperture in the tank chamber T at position 21 and a clear window member 19 sealed to the border of the sill section 19 at position 20.

In use, the lid X is first lifted by means of a hoist H and hoist straps 22. This allows flux and welding rods (not shown) to be inserted within the interior of the tank chamber T. After this, the lid X is replaced atop the tank chamber and sealed at position 11. The pump motor M is activated manually or automatically which then activates the vacuum pump P through the connecting drive shaft 16. As the vacuum pump P draws air from the interior of the tank chamber T, the lid X is pneumatically sealed to the top perimeter 11 of the tank chamber T. The vacuum gauge G reflects the vacuum level within the tank chamber T and indicates to an operator when the vacuum is substantially complete, or the system may be designed to automatically turn off the vacuum pump P and pump motor M at a predetermined vacuum level. This vacuum is retained within the tank chamber T for the necessary period of time to complete the specific drying cycle for the flux and welding rod materials until the materials are needed. To access the materials within the tank chamber T, the atmospheric pressure removed during the drying cycle by the vacuum pump P is allowed to re-enter the tank chamber by opening the pressure release valve 50 lever 51 on the top side 12 of the lid X. Once the pressure within the tank chamber T is equalized to the atmospheric pressure, the seal 11 and the lid X can be lifted by means of the hoist H and hoist straps 22 to access and remove the dried flux, welding rods, welding wire or welding components as needed.

Figure 4:
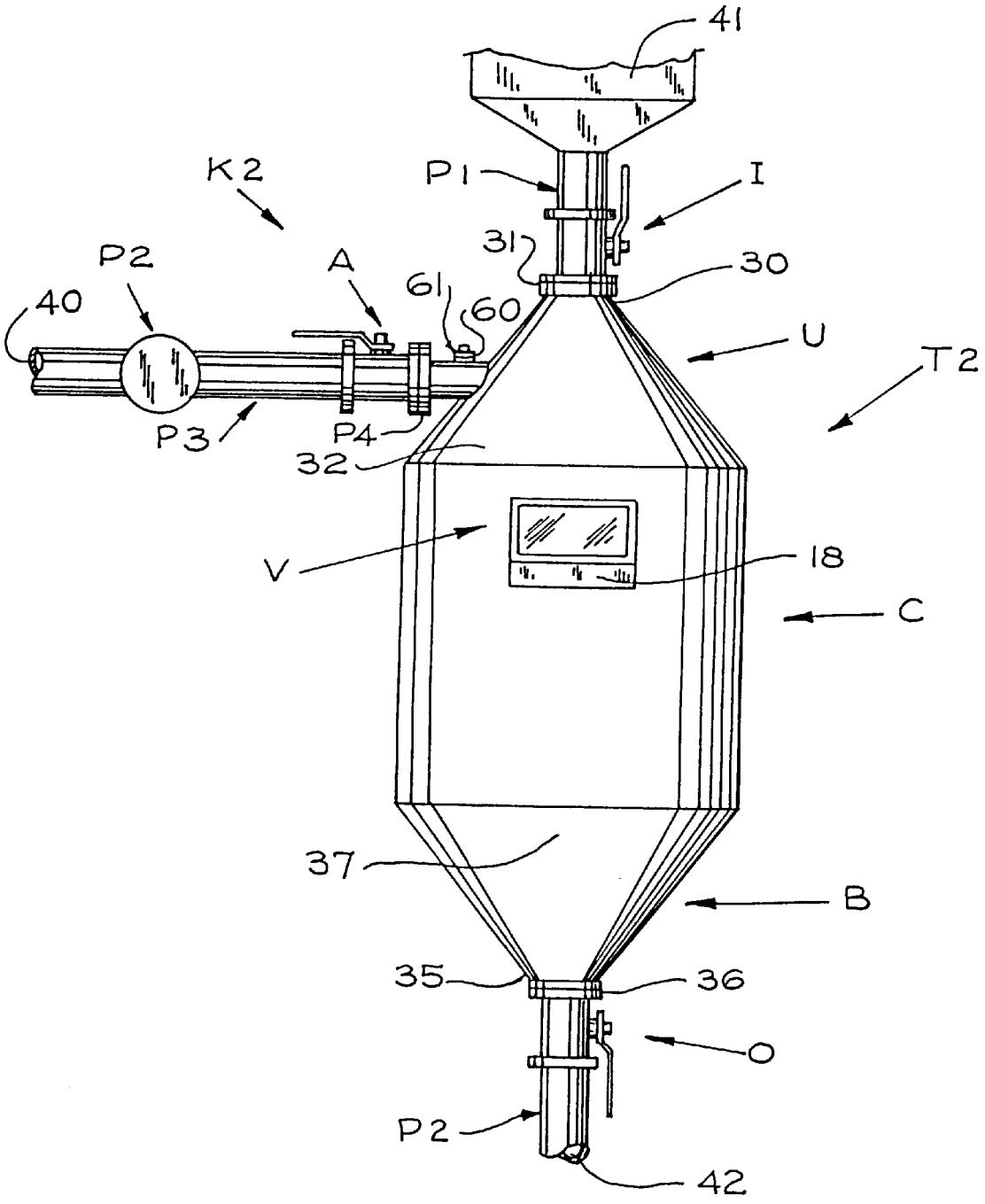
FIG. 4 is a front elevational view of a second embodiment of the degasser tank utilizing a sealed containment tank with separate material inlet and outlet valves.

Referring to FIG. 4, there is shown an alternative embodiment of the present vacuum degasser tank K2. This embodiment K2 provides for access of granular flux material into the tank chamber T2 by means of an input pipe P1 through and inlet control valve I and exit of dried granular flux material through an output control valve O and output pipe P2. This embodiment comprises a tank chamber T2 made of a cylindrical center section C, a top conical section U, and a bottom conical section B. The preferred material of the tank chamber T2 is mild steel, but it is to be understood that a variety of materials may be used to accomplish the same desired function.

Referring further to FIG. 4, the narrow end 30 of the top conical section U is connected to the inlet control valve I at joint 31 with pipe P1 and the wide end 32 of the top conical section U is fastened to the perimeter of the center section C. The narrow end 35 of the bottom conical section B is connected to the output control valve O at joint 36 with pipe P2 and the wide end 37 of the bottom conical section B is fastened to the perimeter of the center section C. The valves are preferably ball valves, but any suitable valve could be used.

The vacuum pump P is connected to pipe P3 that is fastened to the vacuum control valve A and leads into the top conical section U through pipe P4. The vacuum pump P is a MARVAC Scientific Z30 vacuum pump, but others may be used depending on the tank volume and pump oil reservoir capacity needed. On the top of pipe P4 is a pressure release valve 60 and an attached release valve handle 61. An optimal viewing window V and a light housing 18 are formed in the tank chamber T2 to provide a means for viewing the contents of the tank chamber T2.

In use, the outlet valve O and the vacuum valve A are closed, and the inlet valve I is opened to allow a granular flux material (not shown) to flow from a holding device 41, through pipe P1 and into the tank chamber T2. The inlet valve I is closed when the desired amount of material has entered the tank chamber T2. Next, the vacuum valve A is opened and the vacuum pump P is activated to begin the drying cycle. When the drying cycle is complete, the material within the tank chamber T2 may be stored indefinitely without absorbing moisture, until the material is accessed for use.

To access the materials within the tank chamber T2, the atmospheric pressure removed during the drying cycle by the vacuum pump P2 is allowed to re-enter the tank chamber by opening the pressure release valve 60 lever 61 on the top side 12 of the lid section X. Once the pressure within the tank chamber T2 is equalized to the atmospheric pressure, the outlet valve O may be opened to gravity feed dried material through pipe P2 and out 42 as needed.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus comprising:

a degasser tank for removing moisture from welding flux, welding rods, welding wire and welding torch components further comprising:

a substantially air tight chamber having an inner and an outer surface;

a lid section having a top and a bottom surface, the lid being removably attached to the chamber;

a vacuum pump, the vacuum pump attached to the lid;

a pressure gage, the pressure gage attached to the lid;

a pressure release valve, the pressure release valve attached to the lid.

2. The degasser tank apparatus of claim 1, wherein said tank chamber has a top and a bottom, the top being sealable with said lid.

3. The degasser tank apparatus of claim 1, wherein said tank chamber has attached on the outer surface thereof a viewing window, the viewing window having a sill section and a clear window member.

4. The viewing window of claim 3, wherein said sill section is connected to the outer surface of said tank chamber at a generally upwardly angle, the opposite end of said sill section connected to said clear window member.

5. The degasser tank apparatus of claim 1, wherein said lid section has attached to its top surface a vacuum pump motor connected to said vacuum pump.

6. The degasser tank apparatus of claim 1, wherein said lid section has attached to its top surface a light housing.

7. An apparatus comprising:

a degasser tank for removing moisture from welding materials further comprising:

a substantially air tight tank having a top and a bottom;

a lid, the lid being removably sealed to the tank top;

at least one viewing window, the window connected to the tank;

a vacuum pump, the vacuum pump attached to the lid;

a pressure gage, the pressure gage attached to the lid; and a pressure release valve, the pressure release valve attached to the lid.

8. The degasser tank apparatus of claim 7, wherein said lid is removably sealably positioned on the top of said tank.

9. The degasser tank apparatus of claim 7, wherein said lid has a top surface and a bottom surface, the lid top surface having the vacuum pump attached thereto.

10. The degasser tank apparatus of claim 9, wherein the top surface of said lid has a vacuum pump motor attached thereto, the vacuum pump motor being connected to said vacuum pump.

11. The degasser tank apparatus of claim 9, wherein the top surface of said lid section has a light housing attached thereto, the light housing having an electric lighting means therein.

12. An apparatus comprising:

a substantially airtight degasser tank for removing moisture from flux, welding rods, welding wire, and welding components further comprising:

a center tank section having a top and a bottom;

a top section, the top section attached to the center tank section top;

a bottom section, the bottom section attached to the center tank section bottom;

a vacuum pump having a vacuum control valve and pipe, the vacuum pump connected to the top tank section;

at least one inlet pipe having an inlet valve, the inlet pipe connected to the top tank section;

at least one outlet pipe having an outlet valve, the outlet pipe connected to the bottom tank section;

a pressure gage, the pressure gage attached to the vacuum pipe; and a pressure release valve, the pressure release valve attached to the vacuum pipe.

13. The degasser tank apparatus of claim 12, wherein said top conical section has a wide end and a narrow end, the wide end being connected to the top of said center section, the narrow end of said top conical section being connected to said inlet pipe.

14. The degasser tank apparatus of claim 12, wherein said bottom conical section has a wide end and a narrow end, the wide end being connected to the bottom of said center section, the narrow end of said bottom conical section being connected to said outlet pipe.

15. The degasser tank apparatus of claim 12, wherein a viewing window having a sill section and a clear window member is attached to the center tank section.

16. The degasser tank apparatus of claim 15, wherein said sill section is connected to the center tank section at a generally upwardly angle, the opposite end of said sill section connected to said clear window member.

17. A degasser tank apparatus for removing moisture from welding flux, welding rods, welding wire and welding components, the apparatus comprising:

a cylindrical air tight tank chamber having an inner and outer surface;

a circular lid section having a top and a bottom surface, the lid being removably attached to the chamber a vacuum pump, the vacuum pump attached to the circular lid;

said lid section having attached to its top surface a plurality of hoist strap clips.

* * * * *